US010215131B2

(12) United States Patent
Schulz et al.

(10) Patent No.: US 10,215,131 B2
(45) Date of Patent: Feb. 26, 2019

(54) HAND-GUIDED POWER TOOL WITH AN INTERNAL COMBUSTION ENGINE

(71) Applicant: Andreas Stihl AG & Co. KG, Waiblingen (DE)

(72) Inventors: Andreas Schulz, Ettlingen (DE); Przemyslaw Zurek, Backnang (DE); Tobias Bernhard, Obrigheim-Asbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 15/728,856

(22) Filed: Oct. 10, 2017

(65) Prior Publication Data

US 2018/0119647 A1 May 3, 2018

(30) Foreign Application Priority Data

Oct. 31, 2016 (EP) ..... 16400048

(51) Int. Cl.
*F02M 1/02* (2006.01)
*B27B 17/08* (2006.01)
(Continued)

(52) U.S. Cl.
CPC ..... *F02M 1/02* (2013.01); *B27B 17/083* (2013.01); *F02B 63/02* (2013.01); *B27B 17/02* (2013.01);
(Continued)

(58) Field of Classification Search
CPC ..... F02M 1/16; F02M 1/02; F02M 17/04; F02M 63/0225; F02M 31/20; Y02T 10/126; Y02T 10/36; Y02T 10/121; Y02T 10/32; F02D 19/081; F02D 19/0647; F02D 19/0665; F02D 19/0678; F02D 33/006; F02D 37/02; F02D 2009/0254; F02D 2009/0244; F02B 61/045; F02B 63/02;
(Continued)

(56) References Cited

U.S. PATENT DOCUMENTS 4,113,808 A 9/1978 Hackbarth et al.
7,275,508 B2 * 10/2007 Pattullo ..... F02M 1/02 123/179.18

(Continued)

*Primary Examiner* — Hai H Huynh
*Assistant Examiner* — Gonzalo Laguarda
(74) *Attorney, Agent, or Firm* — Gudrun E. Huckett

(57) ABSTRACT

A power tool has an internal combustion engine with a carburetor with choke element pivotably arranged therein. A starter device with an actuating element has an operating position, off position, and at least one start position. A coupling element connects the actuating element with a choke actuating lever. The actuating element, upon adjustment from operating position into the at least one start position, moves the choke element into its start position. The connection between actuating element and choke actuating lever has a relative movement device which, in one position of the choke element, enables movement of actuating element relative to choke actuating lever. A holding device with guide contour is secured on the carburetor housing. In a start position of the choke element, the guide contour prevents movement of the actuating element relative to choke actuating lever from its start position into the operating position.

15 Claims, 7 Drawing Sheets

(51) Int. Cl.

| | |
|---|---|
| ***F02B 63/02*** | (2006.01) |
| *B27B 17/02* | (2006.01) |
| *F02N 3/02* | (2006.01) |
| *F02D 9/02* | (2006.01) |

(52) U.S. Cl.
CPC ..... *F02D 2009/0254* (2013.01); *F02N 3/02* (2013.01)

(58) Field of Classification Search
CPC ..... Y10S 261/68; B27B 17/083; B27B 17/02; F02N 3/02
USPC ..... 123/437, 400; 261/64.6, 39.5
See application file for complete search history.

(56) References Cited

U.S. PATENT DOCUMENTS

| | | | | |
|---|---|---|---|---|
| 8,511,650 | B2 | 8/2013 | Kern et al. | |
| 8,695,952 | B2 * | 4/2014 | Shebuski | F02M 7/24 261/64.1 |
| 9,429,107 | B2 * | 8/2016 | Groh | F02N 19/00 |
| 2004/0035394 | A1 | 2/2004 | Gerhardy | |

* cited by examiner

HAND-GUIDED POWER TOOL WITH AN INTERNAL COMBUSTION ENGINE

BACKGROUND OF THE INVENTION

The invention relates to a hand-guided power tool with an internal combustion engine and with a carburetor that comprises a carburetor housing in which an intake passage section is formed, wherein in the intake passage section a pivotably supported choke element is arranged. The choke element is in operative connection with a choke actuating lever. A starter device is provided that comprises an operating position, an off position, and at least one start position, wherein the starter device comprises an actuating element to be actuated by the operator. The actuating element is operatively connected by a coupling element with the choke actuating lever. When the actuating element is moved from an operating position into a start position of the actuating element, the actuating element moves the choke element into a correlated start position of the choke element.

U.S. Pat. No. 8,511,650 discloses in connection with a hand-guided power tool a carburetor assembly for an internal combustion engine that comprises a starter device. The starter device comprises an operating mode selector to be actuated by the operator. The operating mode selector is connected by means of a coupling rod to a choke lever of a choke element. The assembly is designed such that each position of the operating mode selector has correlated therewith a position of the choke actuating lever and thus a position of the starter device. Based on the position of the operating mode selector, the operator therefore can easily recognize the actual position of the starter device.

In the operating position and in the off position, the choke element usually assumes the same position. Accordingly, between the operating position and the off position of the actuating element, a movement of the actuating element must be possible without the choke actuating lever moving. This is realized in known systems by appropriate positioning of the levers relative to each other.

It is the object of the invention to provide a hand-guided power tool of the aforementioned kind that enables a flexible arrangement of the actuating element.

SUMMARY OF THE INVENTION

This object is solved by a hand-guided power tool that is characterized in that the operative connection between the actuating element and the choke actuating lever comprises a relative movement device which, in at least one position of the choke element, permits a relative movement of the actuating element of the starter device relative to the choke actuating lever and in that the relative movement device comprises a holding device, wherein the holding device comprises a guide contour which is stationarily arranged on the carburetor housing and which, in at least one start position of the choke element, holds the actuating element in the start position and prevents a relative movement of the actuating element relative to the choke actuating lever from the start position into the operating position of the starter device.

In order to enable a movement of the actuating element, for example, of an operating mode selector, relative to the choke actuating lever, it is provided that the operative connection between the actuating element and the choke actuating lever comprises a relative movement device. The relative movement device permits in at least one position of the choke element a relative movement of the actuating element relative to the choke actuating lever. Due to the relative movement device, the position of the pivot axis of the choke actuating lever must not be selected such that the actuating element can move—without a noticeable movement of a coupling location on the choke actuating lever—between the operating position and the off position. Instead, it is possible to select the position of the choke actuating lever substantially at will. The relative movement of the actuating element relative to the choke actuating lever is enabled by the relative movement device. The relative movement device enables in particular a relative movement of the coupling element relative to the choke actuating lever and relative to the choke element.

However, it is desirable that, based on the position of the actuating element, the operator can still recognize in which position the starter device is positioned. In order to ensure this, a holding device is provided which comprises a guide contour that is stationarily arranged on the carburetor housing. In at least one start position of the choke element, the guide contour holds the actuating element in the start position and prevents a relative movement of the actuating element relative to the choke actuating lever from the start position into the operating position.

In this way, the holding device ensures at the same time that the position of the actuating element is coupled to the position of the choke actuating lever. In at least one start position, preferably in a warm start position, the actuating element due to the holding device cannot move relative to the choke actuating lever from the start position into the operating position. In this way, it is ensured that the actuating element remains positioned in the correlated start position when the starter device is in the start position and cannot move by means of the relative movement device relative to the choke actuating lever. A movement of the actuating element relative to the choke actuating lever could result in the actuating element no longer being positioned in the correlated start position but, for example, in the operating position, even though the choke actuating lever is positioned in the start position. This is prevented by the holding device in a simple way.

Advantageously, the relative movement device in operating position of the choke element permits a relative movement of the actuating element of the starter device relative to the choke actuating lever so that the choke actuating lever is not moved when the actuating element is moved between the operating position and the off position. Advantageously, the holding device blocks the relative movement device in start position of the actuating element. The holding device effects that a movement of the actuating element from the operating position into the at least one start position causes a movement of the choke actuating lever. Due to the movement of the choke actuating lever, an adjustment of the choke element into the correlated start position of the choke element is effected. The holding device can block the relative movement device and/or can hold the choke element in at least one start position. Advantageously, the choke element always moves together with the choke actuating lever.

The operating position of the choke element is in particular the position in which the choke element opens the cross section of the intake passage. A start position of the choke element is a position in which the choke element closes off the cross section of the intake passage partially up to a point of almost completely closure of the cross section of the intake passage section.

Advantageously, the relative movement device comprises a slotted hole in which a guide element engages. In the slotted hole, the guide element moves from a first position into a second position upon adjustment of the actuating element from the operating position into the off position. Due to the movement of the guide element in the slotted hole, a relative movement of the guide element relative to the choke actuating lever can be enabled in a simple way. Due to the movement of the guide element in the slotted hole, a relative movement of the actuating element relative to the choke actuating lever can thus be enabled also. Upon adjustment of the actuating element from the operating position into at least one start position, the guide element preferably moves from the first position into at least a third position.

Advantageously, the slotted hole comprises a first section and a second section that are positioned at an angle of advantageously more than 45° relative to each other and are connected by a connecting section with each other. The slotted hole comprises in particular an angular, preferably an approximately L-shaped configuration. Alternatively, a configuration of the slotted hole which deviates from the L-shape can be advantageous also. In particular, a straight slotted hole can be provided. The choke actuating lever and a throttle lever, connected with a throttle element that is arranged in the intake passage, lock advantageously in planes that are displaced relative to each other for securing at least one start position.

In the second position, the guide element is advantageously located in the first section. In the second position, the actuating element is arranged in off position. In case of an L-shaped configuration of the slotted hole, the first section is preferably the longer leg of the L. In the third position, the guide element is advantageously located in the second section. In the third position, the actuating element is in the start position. In case of an L-shaped configuration of the slotted hole, the second section is preferably the short leg of the L. Particularly preferred, in the first position, i.e., in operating position of the starter device, the guide element is located in the connecting section. In the first position, the actuating element is in operating position. From the connecting section, the guide element can be moved into the first section upon adjustment into the off position and into the second section upon adjustment into a start position.

Advantageously, the guide contour closes off at least one section of the slotted hole for the guide element in the at least one start position. In this way, the guide contour prevents in a simple way that the guide element can be moved into a section, in particular into the section which is correlated with the off position. Upon adjustment of the actuating element into the start position, it is ensured that the choke actuating lever is adjusted also into the correlated start position. When the choke actuating lever is in a start position, the guide contour prevents that the guide element can be moved into the section of the slotted hole correlated with the off position and in particular into the section of the slotted hole correlated with the operating position. In this way, it is ensured that the actuating element is in the position which is correlated with the start position and the operator, with the aid of the position of the actuating element, can unequivocally determine the position of the starter device.

Preferably, the guide contour is formed on a control opening into which the guide element is projecting. In operating position of the choke element, the control opening overlaps advantageously completely the slotted hole in the movement range of the coupling element. In this way, the entire slotted hole is accessible for the guide element and the guide element can be adjusted into the off position as well as into the at least one start position. The movement range of the coupling element is in this context the section of the slotted hole in which the coupling element can move. The guide contour is advantageously embodied on a component that is connected fixedly with a carburetor housing of the carburetor. It can be advantageous that the guide contour is embodied on the carburetor housing itself. A simple configuration results however by embodying the guide contour on a separate component. The separate component is preferably comprised of plastic material. In this way, a simple configuration and simple manufacture result.

Advantageously, the guide element is formed on the coupling element and the slotted hole on the choke actuating lever. An embodiment of the guide element on the choke actuating lever and an embodiment of the slotted hole on the coupling element can however be advantageous. Preferably, the coupling element is designed as a wire bracket. The guide element is advantageously formed by an angled end of the wire bracket. Particularly preferred, the choke actuating lever is fixedly connected with the choke element. However, for tolerance compensation, a springy support of the choke actuating lever relative to the choke element can be provided also that enables a relative movement of the choke actuating lever relative to the choke element within a limited angular range. The choke actuating lever and a control part on which the guide contour is embodied form together advantageously a guide structure for the guide element.

DESCRIPTION OF THE PREFERRED EMBODIMENTS

Figure 1:
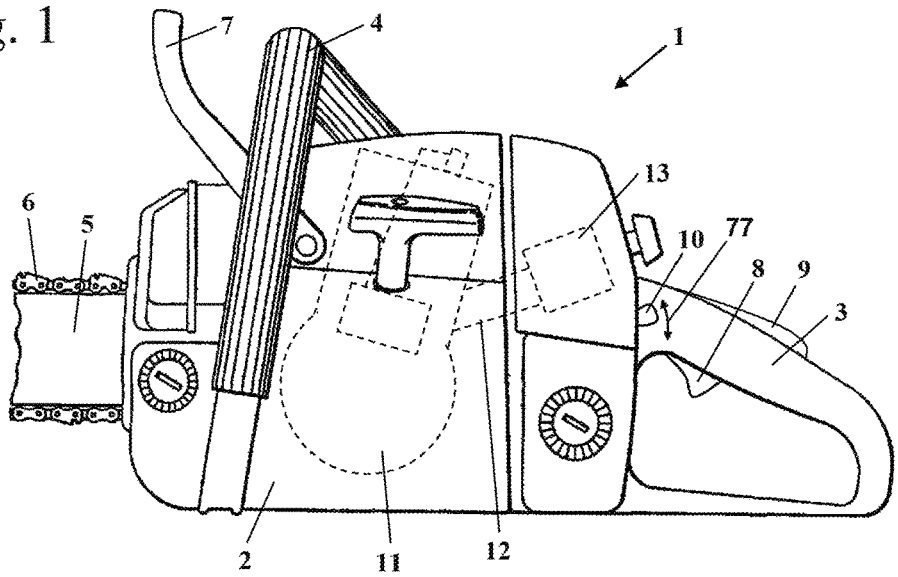
FIG. 1 shows a schematic side view of a motor chainsaw.

FIG. 1 shows a motor chainsaw 1 as an embodiment of a hand-guided power tool. However, the hand-guided power tool can also be a cut-off machine, a trimmer, a blower, a lawnmower or the like. The motor chainsaw 1 comprises a chainsaw housing 2 in which an internal combustion engine 11 is arranged. For guiding the motor chainsaw 1, a rear handle 3 is provided which is connected by means of vibration damping elements, not illustrated, to the chainsaw housing 2. A tubular front handle 4 that extends about the chainsaw housing 2. On the rear handle 3, a throttle trigger 8 as well as a throttle trigger lock 9 are pivotably supported. The throttle trigger 8 serves for operating the internal combustion engine 11. Adjacent to the rear handle 3 there is also an actuating element 10 provided which is configured as an operating mode selector in the embodiment and which is pivotable into different positions as schematically indicated by arrow 77. On the chainsaw housing 2, a guide bar 5 is arranged and a saw chain 6 is supported on its circumference. The saw chain 6 is the tool of the motor chainsaw 1 and is driven in circulation about the guide bar 5 by the internal combustion engine 11. The internal combustion engine 11 comprises a carburetor 13 that serves for supplying fuel/air mixture and that is connected by an intake passage 12 with the internal combustion engine 11. The internal combustion engine 11 is a single cylinder engine, preferably, a mixture lubricated engine. In the embodiment, the internal combustion engine 11 is a mixture lubricated two-stroke engine. The internal combustion engine can however also be a four-stroke engine, in particular a mixture-lubricated four-stroke engine. On the chainsaw housing 2, a hand guard 7 is pivotably supported which is extending on the side of the tubular front handle 4 which is facing the saw chain 6 and advantageously serves for triggering a braking device, not illustrated, for the saw chain 6.

Figure 2:
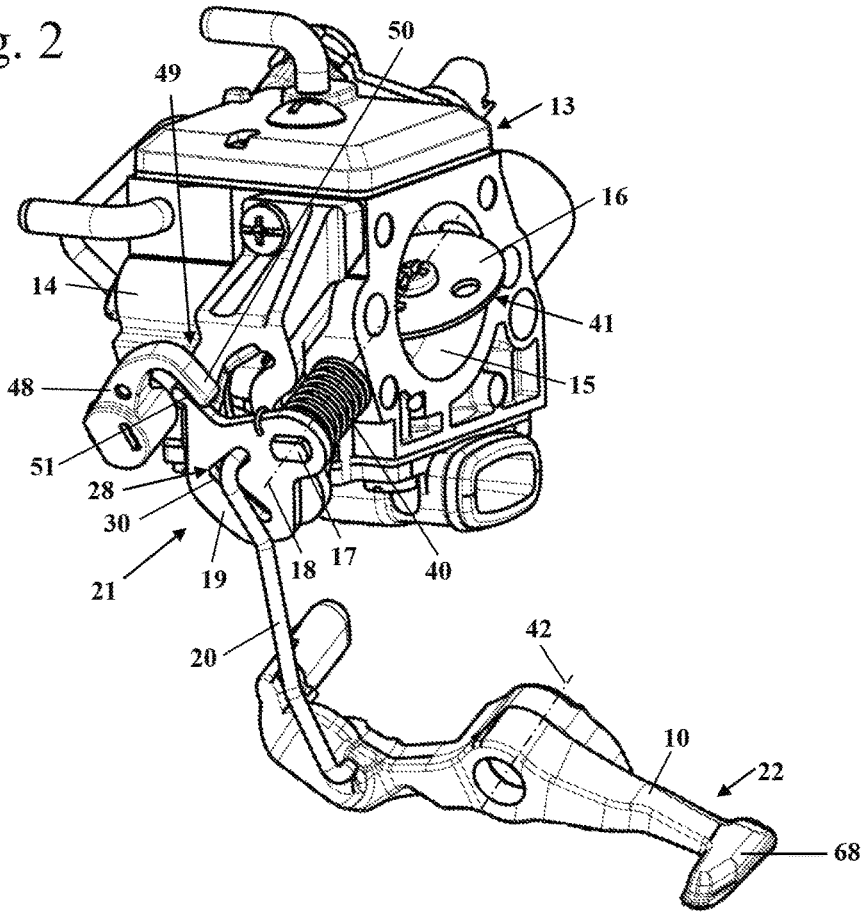
FIG. 2 shows the carburetor and the actuating element of the motor chainsaw of FIG. 1 in perspective illustration in operating position.

FIG. 2 shows the configuration of the carburetor 13 in detail. The carburetor 13 comprises a carburetor housing 14 in which an intake passage section 15 is formed. In the intake passage section 15, a choke element 16, in the embodiment a choke flap, is supported by choke shaft 17 so as to be pivotable about axis of rotation 18. FIG. 2 shows the choke element 16 in an operating position 41 in which the choke element 16 substantially opens up the flow cross section in the intake channel section 15. A spring 40, in the embodiment a torsion spring, is arranged on the choke shaft 17 and pretensions the choke element 16 in the direction of the operating position 41 illustrated in FIG. 2. On the exterior side of the carburetor housing 14, a choke actuating lever 19 is arranged on the choke shaft 17. In the embodiment, the choke actuating lever 19 is connected fixedly with the choke shaft 17. However, for the purpose of tolerance compensation, a connection between the choke actuating lever 19 and the choke shaft 17 can be provided that enables a limited relative movement between the choke actuating lever 19 and the choke shaft 17.

A coupling element 20, in the embodiment a wire bracket, is hooked into the choke actuating lever 19. A different configuration of the coupling element 20 can be advantageous. The second end of the coupling element 20 is hooked into the actuating element 10. The actuating element 10 is pivotably supported about pivot axis 42. The actuating element 10 comprises an actuating section 68 which is advantageously projecting from the chainsaw housing 2 of the motor chainsaw 1 (FIG. 1). The coupling element 20 is advantageously fastened in an area of the actuating element 10 which is arranged on the side of the pivot axis 42 opposite the actuating section 68.

For starting the internal combustion engine 11, the carburetor 13 is moved into a start position. For this purpose, a starter device 21 is provided on the carburetor 13. The starter device 21 comprises the actuating element 10, the coupling element 20, the choke actuating lever 19, the choke shaft 17, the choke element 16 as well as a throttle lever 48 which is connected fixedly with a throttle element 52 (FIG. 3) supported downstream of the choke element 16 in the intake passage section 15. As also shown in FIG. 2, the coupling element 20 is hooked in a slotted hole 30 of the choke actuating lever 19. The slotted hole 30 is configured as a part of a relative movement device 28. In FIG. 2, the starter device 21 is in an operating position 22.

Figure 3:
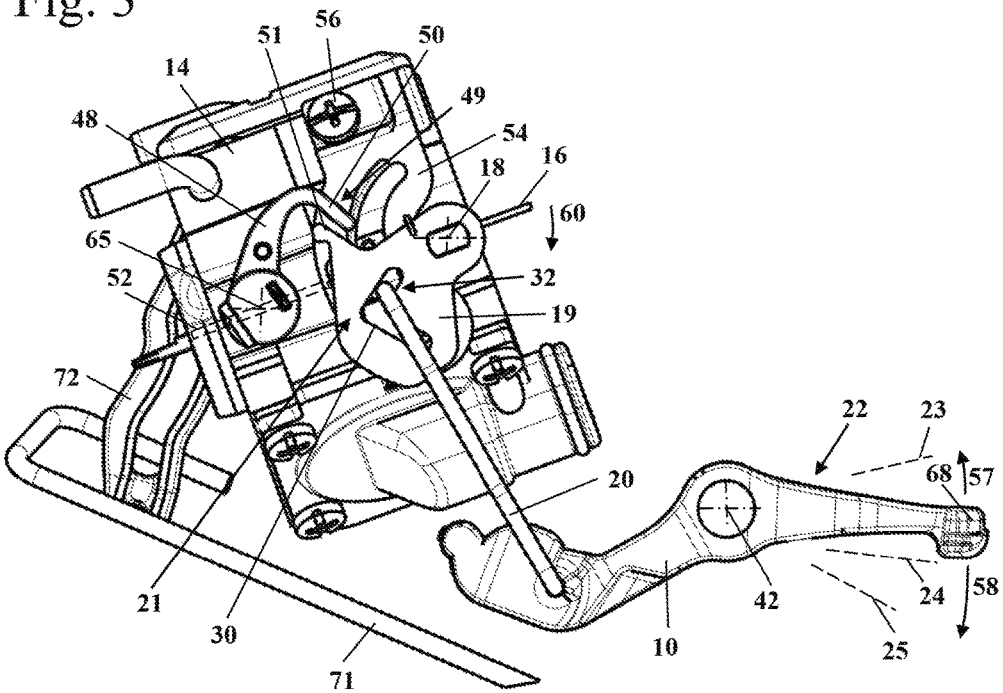
FIG. 3 shows the arrangement of FIG. 2 in a side view
Figure 4:
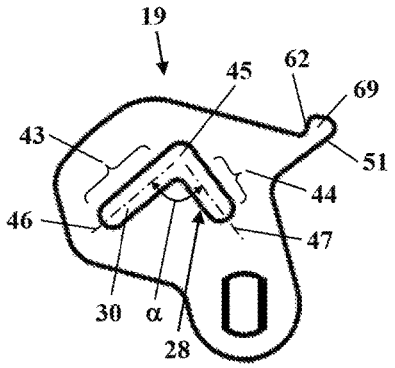
FIG. 4 is a side view of the choke actuating lever of the carburetor arrangement.

As shown in FIG. 3, the coupling element 20, in the operating position 22 of the starter device 21, is in a first position 32 in the slotted hole 30. In the first position 32, the coupling element 20 can move in the slotted hole 30 in both directions, i.e., into a first section 43 and into a second section 44. The first and second sections 43 and 44 are shown in FIG. 4 and will be explained in more detail in the following. In FIG. 3, the throttle element 52 is also schematically illustrated. In the embodiment, the throttle element 52 is a throttle flap. The throttle element 52 is pivotably supported about an axis of rotation 65.

In the operating position 22, the throttle lever 48 and the choke actuating lever 19 are in a blocking position 49. In the blocking position 49, the blocking section 50 of the throttle lever 48 blocks a blocking section 51 of the choke actuating lever 19. The choke element 16 cannot be pivoted in the direction of arrow 60, i.e., in the closing direction of the choke element 16, without first pivoting the throttle lever 48 out of the movement range of the choke actuating lever 19. For pivoting the choke actuating lever 19 in the direction of arrow 60, i.e., for selecting a start position, first the throttle trigger 8 (FIG. 1) must be suppressed by the operator and the throttle lever 48 pivoted thereby out of the movement range of the choke actuating lever 19. Selecting a start position without prior actuation of the throttle trigger 8 is thus prevented. In the embodiment, the throttle trigger 8 is acting on the throttle actuating rod 71. For actuating the throttle element 52, the throttle actuating rod 71 acts by an intermediate lever 72 on an actuating lever, not illustrated, that is connected fixedly with the throttle element 52.

In FIG. 3, the further possible positions of the actuating element 10 are indicated schematically. By pivoting the actuating section 68 in the direction of arrow 57, i.e., in upward direction in FIG. 3, the starter device 21 is moved into an off position 23. Advantageously, the off position 23 is designed as a push button switch. In the off position 23, ignition of the internal combustion engine 11 is advantageously short-circuited so that the internal combustion engine 11 is switched off. The actuating element 10 is however advantageously supported in a springy fashion in the direction of the operating position 22 of the starter device 21 and returns again into the operating position 22 after the operator has released the actuating element 10. In an alternative design, it can be advantageously provided that the actuating element 10 is locked in the off position 23 and must be adjusted back into the operating position 22 by the operator.

By pivoting the actuating element 10 in the direction of arrow 58, in FIG. 3 in downward direction, the operator can adjust the starter device 21 into a second start position 25, in the embodiment into a cold start position. For adjusting the starter device 21 into a first start position 24, in particular a warm start position, the operator can pivot the actuating element 10 back in the direction of arrow 57. For returning the actuating element 10 into the operating position 22, the operator can actuate the throttle trigger 8 so that as a result thereof the locking action between the choke actuating lever 19 and the throttle lever 48, described in the following in more detail, is canceled.

Figure 14:
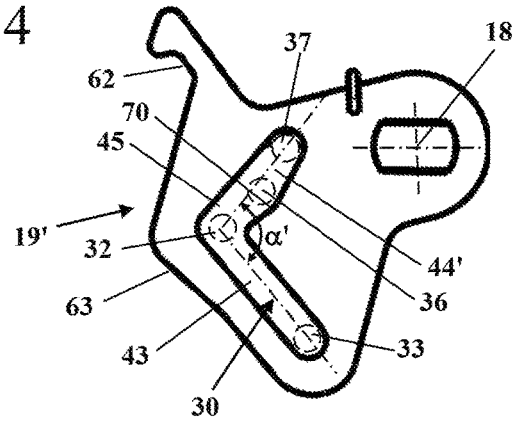
FIG. 14 is a side view of the choke actuating lever of the carburetor arrangement of FIG. 13 in a side view, schematically illustrating the guide element in different positions.

FIG. 4 shows the configuration of the choke actuating lever 19 in detail. The slotted hole 30 comprises the first section 43 and the second section 44. The first section 43 and the second section 44 are connected to each other by a connecting section 45. The first section 43 comprises a longitudinal center axis 46. The second section 44 comprises a longitudinal center axis 47. The longitudinal center axes 46 and 47 are positioned at an angle α relative to each other which is advantageously greater than 45°. In the embodiment, the angle α is approximately 90°. In the embodiment, the first section 43 is longer than the second section 44. In the embodiment, therefore an approximately L-shaped configuration results for the slotted hole 30. The slotted hole 30 forms in the embodiment a relative movement device 28. The relative movement device 28 enables a relative movement of the coupling element 20 relative to the slotted hole 30. In FIG. 14, an embodiment variant of the slotted hole 30 is illustrated. As shown in FIG. 4, the blocking section 51 is formed on a nose 69 of the choke actuating lever 19. On the opposite side of the nose 69, a contact contour 62 is formed whose function will be explained in the following in more detail.

Figure 5:
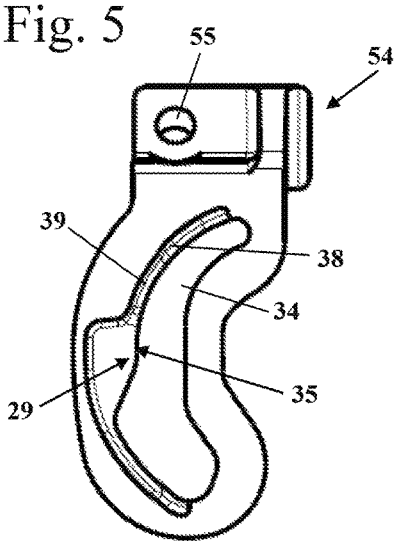
FIG. 5 is a side view of a control part of the arrangement of FIG. 3.
Figure 6:
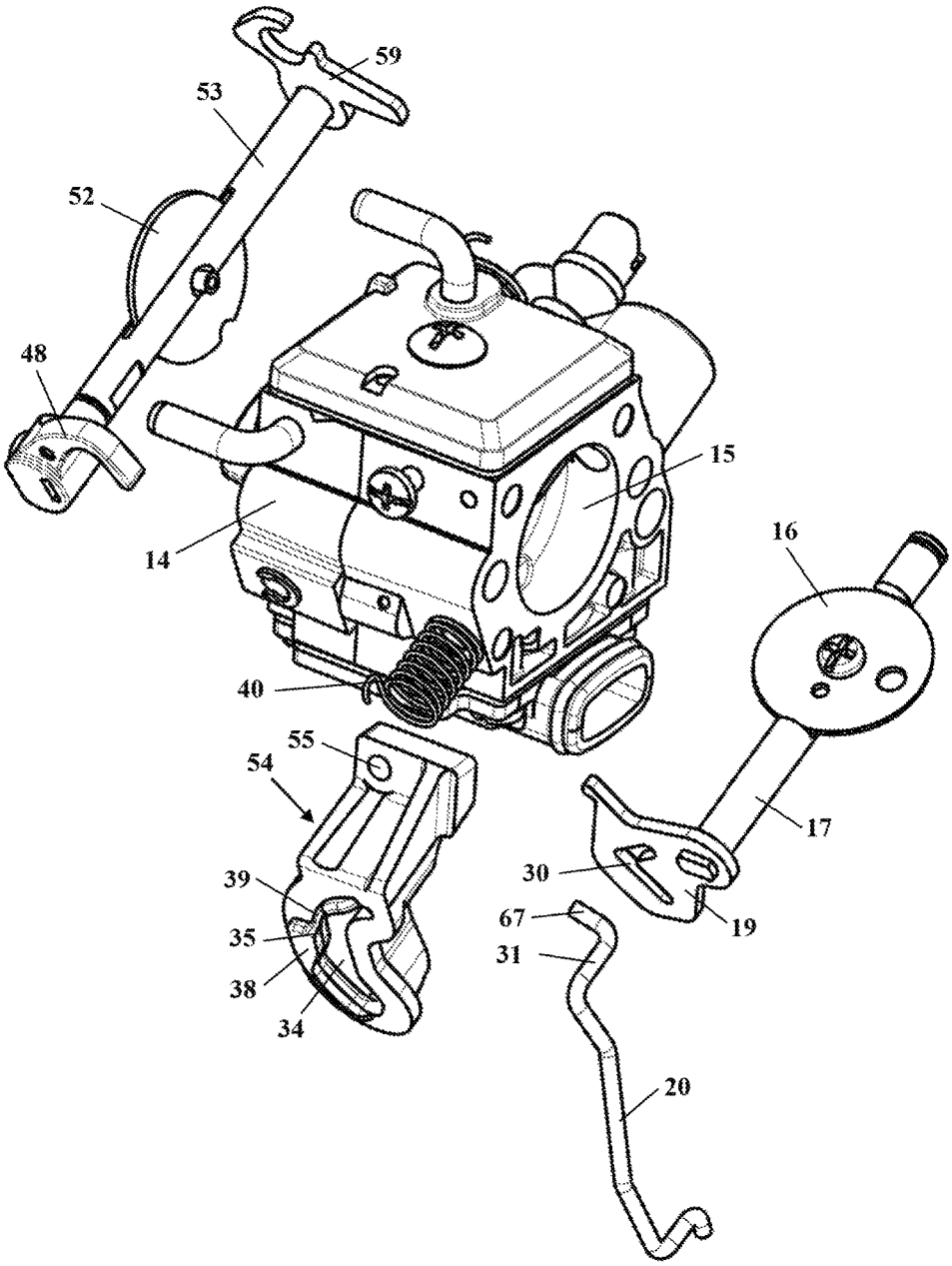
FIG. 6 is a partially exploded illustration of the carburetor.

On the carburetor housing 14, a control part 54 is secured, as shown in FIG. 3. In the embodiment, the control part 54 is fixed by a fastening screw 56 on the carburetor housing 14. The fastening screw 56 projects through a fastening opening 55 of the control part 54 which is illustrated in FIG. 5. Alternatively, the control part 54 can be formed as one piece together with the carburetor housing 14 (FIG. 3). As also shown in FIG. 5, the control part 54 has a control opening 34 which in the embodiment has in approximation a C-shaped, essentially arc-shaped course. The coupling element 20 (FIG. 3) projects through the slotted hole 30 as well as through the control opening 34 which is positioned between the choke actuating lever 19 and the carburetor housing 14. The slotted hole 30 and the control opening 34 form in this way a guide structure for a guide element 31 that is formed on the coupling element 20. The guide element 31 is illustrated in FIG. 6. The guide element 31 projects in the embodiment through the choke actuating lever 19 and the control opening 34.

As shown in FIG. 5 and FIG. 6, a guide contour 35 which forms a holding device 29 is provided on the control opening 34. The guide contour 35 is stationarily secured by fastening screw 56 on the carburetor housing 14. The guide contour 35 therefore cannot move in operation relative to the carburetor housing 14. However, it can also be advantageous to configure the guide contour 35 directly on the carburetor housing 14, i.e., form it as one piece together with the carburetor housing 14. In order to achieve a better guiding action for the guide element 31, the holding device 29 is formed on an elevation 38 on the control part 54. In the embodiment, the elevation 38 comprises a recess 39 where the elevation 38 has a reduced height. In the region of the recess 39, the elevation 38 can also be completely eliminated. The recess 39 is arranged in the area in which the throttle lever 48 is located in the operating position 22 (FIG. 3). The recess 39 prevents even in case of an unfavorable tolerance situation that the throttle lever 48 (FIG. 3) comes into contact with the control part 54.

As shown in FIG. 6, the throttle lever 48 is fixedly connected to a throttle shaft 53. The throttle element 52, in the embodiment a throttle flap, is fixed on the throttle shaft 53. A throttle actuating lever 59 is arranged at the end of the throttle shaft 53 opposite the throttle lever 48. The throttle actuating lever 59 is engaged by a transmission device that transmits the actuating movement of the throttle trigger 8 (FIG. 1) to the throttle actuating lever 59 and thus to the throttle element 52. As also shown in FIG. 6, adjacent to the guide element 31, the coupling element 20 of the embodiment comprises a securing section 67 where the coupling element 20 is angled relative to the guide element 31. The securing section 67 in operation engages behind the control part 54 and is positioned between the control part 54 and the carburetor housing 14. The coupling element 20 is secured in this way on the control part 54.

Figure 7:
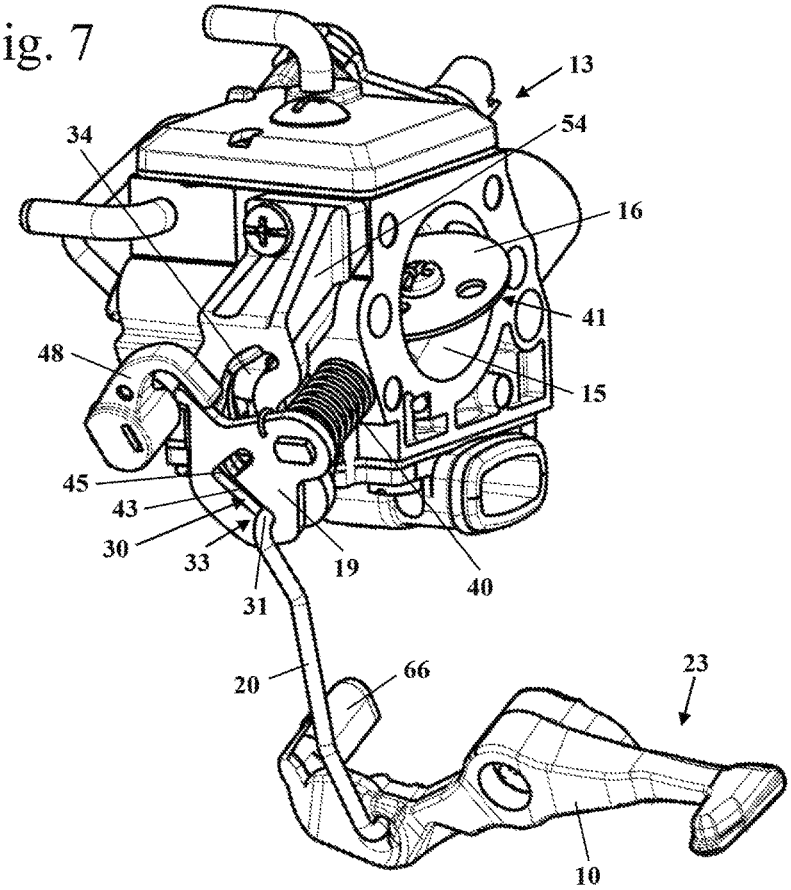
FIG. 7 is a perspective illustration of the carburetor and of the actuating element in an off position.
Figure 8:
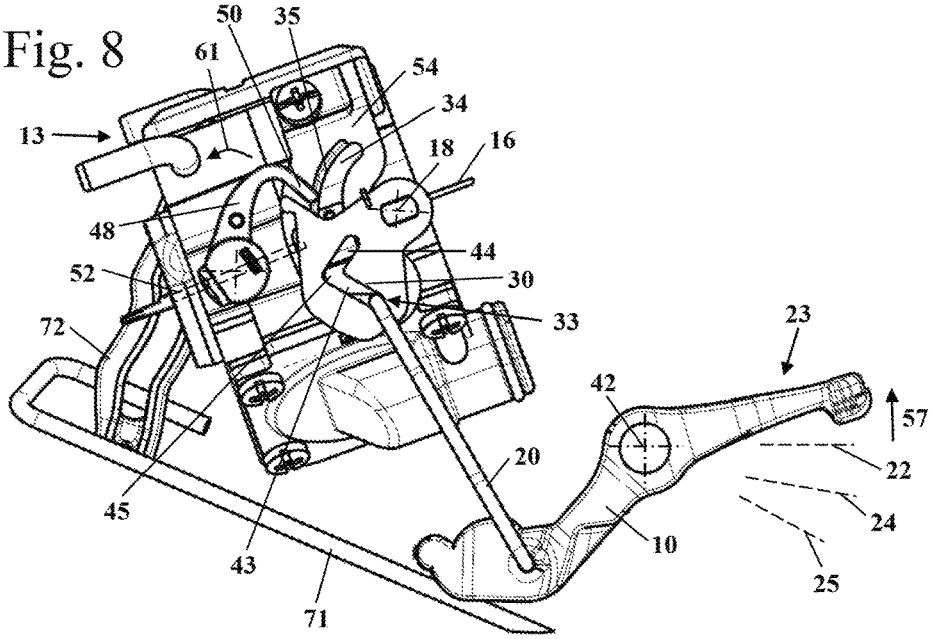
FIG. 8 shows the arrangement of FIG. 7 in a side view.

FIGS. 7 and 8 show the arrangement of the carburetor 13 (FIG. 2) in the off position 23. In the off position 23, the guide element 31 is in a second position 33. In the second position 33, the guide element 31 is arranged at the end of the first section 43 of the slotted hole 30 which is facing away from the connecting section 45. On the actuating element 10, an actuating cam 66 is embodied which advantageously short-circuits in the off position 23 an ignition device of the internal combustion engine 11. When adjusting the actuating element 10 from the operating position 22 into the off position 23, the guide element 31 is moved in the slotted hole 30. The slotted hole 30 is oriented such that, when adjusting the actuating element 10 from the operating position 22 in the direction toward the off position 23, no adjustment or movement of the choke actuating lever 19 results. In the operating position 22 as well as in the off position 23 of the actuating element 10, the choke element 16 is in its operating position 41. The choke element 16 opens the flow cross section of the intake passage section 15 for the most part.

As shown in FIG. 8, the slotted hole 30 and the control opening 34 are overlapping in the off position 23 in the embodiment. The control opening 34 overlaps completely the movement range of the coupling element 20 in the slotted hole 30. The control opening 34 blocks no region of the slotted hole 30 into which the coupling element 20 can move. From the off position 23 illustrated in FIGS. 7 and 8, the actuating element 10 therefore can be adjusted back into the operating position 22 and from there preferably can be adjusted farther into the first start position 24, without the movement of the coupling element 20 in the slotted hole 30 being impaired by the guide contour 35. The region of the slotted hole 30 in which the coupling element 20 is located when the actuating element 10 is in the second start position 25 is also not blocked. The movement of the choke actuating lever 19 out of the operating position 22 into the first start position 24 is only blocked by the blocking section 50 of the throttle lever 48. In order to pivot the throttle lever 48 out of the movement range of the choke actuating lever 19, the operator must actuate the throttle trigger 8 and accelerate. This causes the throttle lever 48 to pivot in the direction of arrow 61; the throttle flap 52 is opened.

Figure 9:
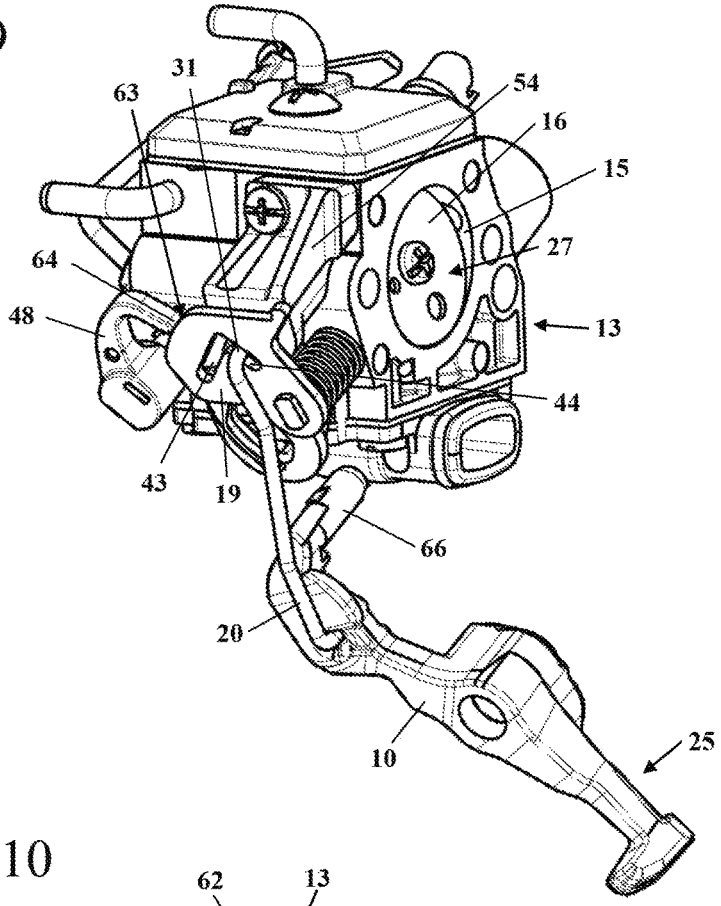
FIG. 9 is a perspective illustration of the carburetor arrangement in a second start position.
Figure 10:
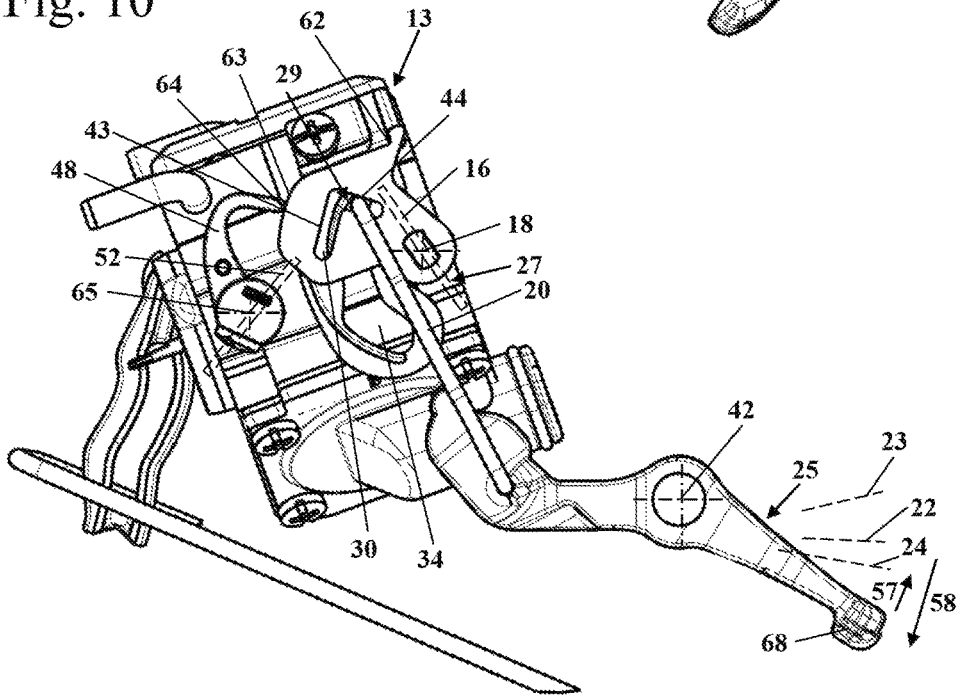
FIG. 10 shows the arrangement of FIG. 9 in a side view.

FIGS. 9 and 10 show the starter device 21 in the second start position 25. For adjusting the starter device 21 from the operating position 22 into the second start position 25, which is advantageously a cold start position, the actuating section 68 is moved in the direction of arrow 58, as schematically shown in FIG. 10. The second start position 25 is selected in that the throttle trigger 8 is actuated, subsequently the actuating element 10 is pivoted, and the throttle trigger 8 is then released again. In this way, the throttle lever 48 contacts with a section 64 the choke actuating lever 19 and holds the choke actuating lever 19 in the corresponding position.

In the second start position 25, the section 64 of the throttle lever 48 contacts a contact contour 68 on the outer circumference of the choke actuating lever 19. The throttle lever 48 holds the choke actuating lever 19 in the second start position 25. As schematically shown in FIG. 10, in the second start position 25 the throttle element 52 is pivoted into an angled position and reduces the free flow cross section in the intake passage section 15. As shown in FIG. 9, the choke element 16 is in a second start position 27 in which the choke element 16 mostly closes off the cross section of the intake channel section 15. As shown in FIGS.

9 through 12, in the second start position 25 the guide element 31 is approximately in the same position within the slotted hole 30 as in the first start position 24. Preferably, in the first start position 24 the holding device 29 blocks the connecting section 45 and the first section 43 of the slotted hole 30 so that the guide element 31 cannot move out of the second section 44 without a movement of the choke actuating lever 19.

Figure 11:
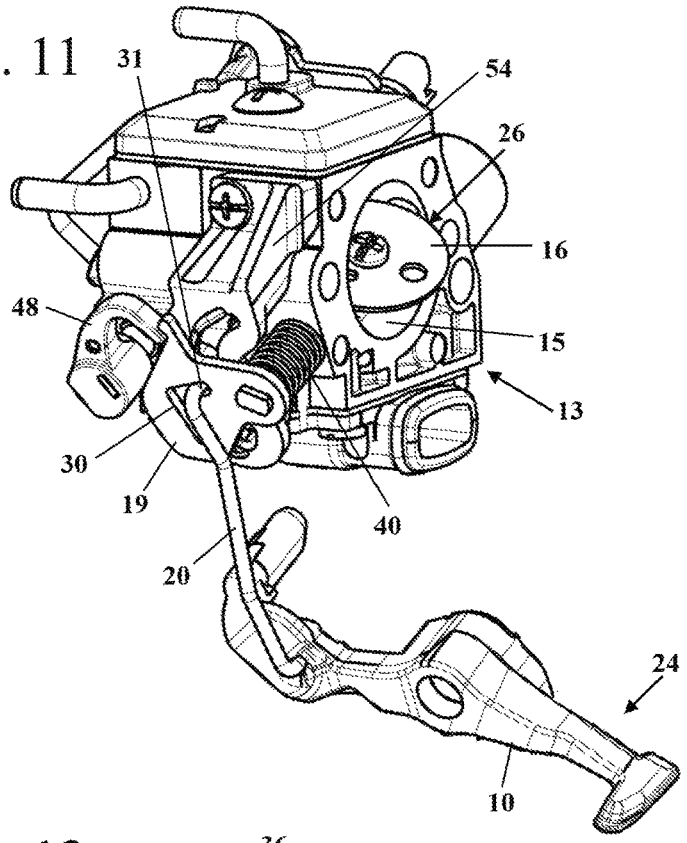
FIG. 11 shows the carburetor arrangement in perspective illustration in a first start position.
Figure 12:
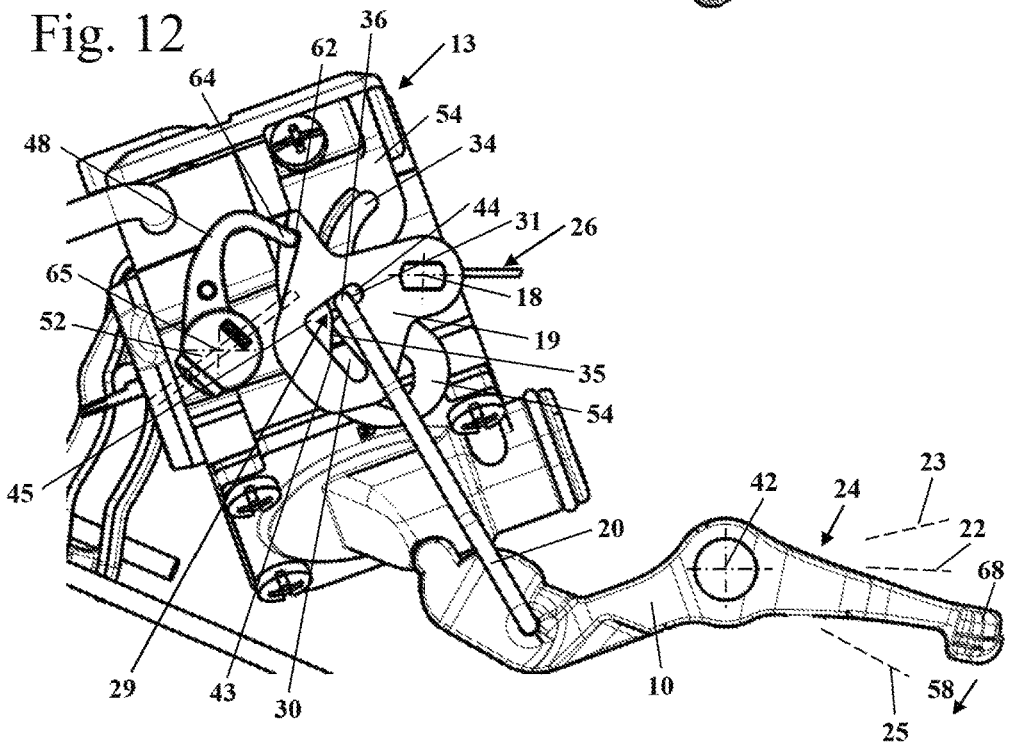
FIG. 12 shows the arrangement of FIG. 11 in a side view.

FIGS. 11 and 12 show the arrangement of the carburetor 13 in the first start position 24 which is a warm start position in the embodiment. By pivoting the actuating element 10 from the second start position 25 in the direction of arrow 57 (FIG. 10), the arrangement can be moved into the first start position 24. A direct selection of the first start position 24 without prior selection of the second start position 25 is not possible in the embodiment. This may be provided for however. As shown in FIGS. 11 and 12, the choke element 16 has been pivoted also and is in a first start position 26. In the first start position 26, the choke element 16 partially closes off the flow cross section in the intake passage section 15.

As shown in FIG. 12, in the first start position 24 the section 64 of the throttle lever 48 is contacting the first contact contour 62 of the choke actuating lever 19. The guide element 31 is located in the second section 44 of the slotted hole 30. As shown in FIG. 12, the control opening 34 is positioned only partially in overlap with the slotted hole 30. The connecting section 45 is for the most part covered by the control part 54. The guide contour 35 prevents that the guide element 31 can reach the connecting section 45 and from there the first section 43 of the slotted hole 30 as long as the choke actuating lever 19 is arranged in the first start position 24. In this way, it is prevented that the actuating element 10 can move into a position which is correlated with the operating position 22 or the off position 23. The guide contour 35 secures the actuating element 10 in the position that is correlated with first start position 24. The guide contour 35 prevents a relative movement of the actuating element 10 relative to the choke actuating lever 19 from the first start position 24 into the operating position 22. The guide element 31 is in a third position 36 in the second section 44 which in the embodiment is approximately at the center of the second section 44. For cancelling the first start position 24, the operator must either accelerate, i.e., actuate and pivot the throttle trigger 8 (FIG. 1), or must push against the actuating element 10 with increased force in the direction of arrow 57 (FIG. 10) so that the section 64 of the throttle lever 48 elastically deforms and the locking action between choke actuating lever 19 and throttle lever 48 is released. The cancellation of the first start position 24 is possible in the embodiment due to the elasticity of the throttle lever 48. The throttle lever 48 is comprised preferably of plastic material. The first start position 24 could alternatively also be cancelled by lateral displacement in the deflection of the longitudinal axis of the choke shaft 17 (FIG. 6). For this purpose, the throttle lever 48 and/or the choke actuating lever 19 could be displaced in the direction of the longitudinal axis of the choke shaft 17 (FIG. 6) or tilted in lateral direction.

Figure 13:
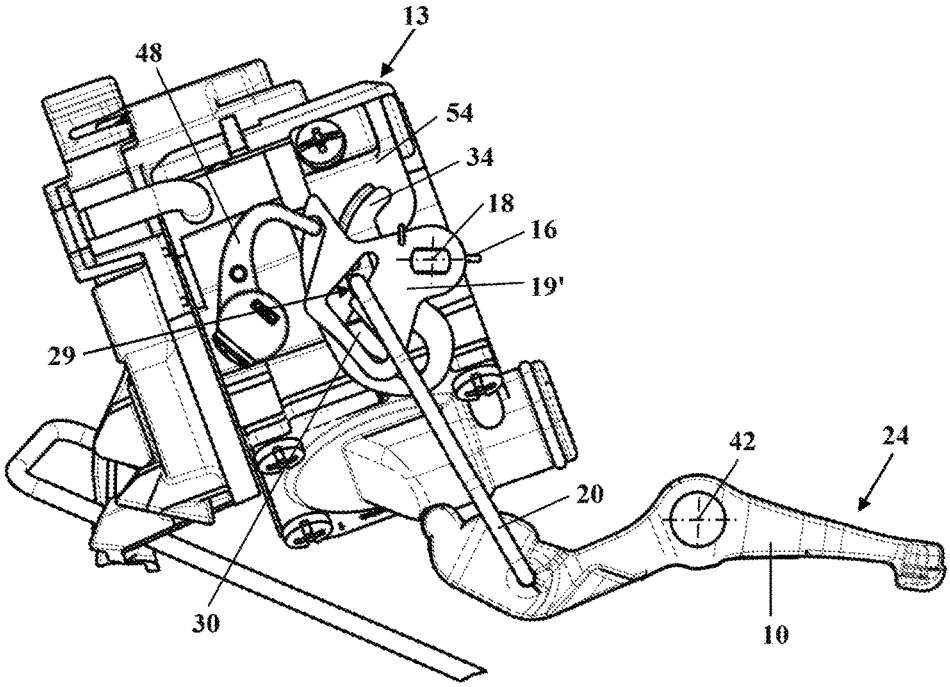
FIG. 13 is an embodiment variant of the carburetor arrangement in a first start position.

FIGS. 13 and 14 show an embodiment variant of a choke actuating lever 19'. Same reference characters characterize in both embodiments elements that correspond with each other. The choke actuating lever 19' differs from the choke actuating lever 19 in regard to the configuration of the slotted hole 30. The choke actuating lever 19' comprises a slotted hole 30' that also has a first section 43, a second section 44', as well as a connecting section 45. The first and second sections 43 and 44' extend at an angle α' relative to each other that is greater than 45°. In the embodiment according to FIGS. 13 and 14, an angle α' of somewhat more than 90° is provided. The second section 44' has on the side where the guide element 31 is contacting in the first start position 24 a depression 70 which serves for tolerance compensation. In the second start position 25, the guide element 31 is located in a fourth position 37, as indicated schematically in FIG. 14. In the fourth position 37, the guide element 31 is located at the end of the second section 44' which is facing away from the connecting section 45. In operating position 22, the guide element 31 is in a first position 32 in the connecting section 45. As in the preceding embodiment, in the off position 23, the guide element 31 is in a second position 33 in which the guide element 31 is arranged at the end of the first section 43 which is facing away from the connecting section 45.

The specification incorporates by reference the entire disclosure of European priority document 16 400 048.1 having a filing date of Oct. 31, 2016.

While specific embodiments of the invention have been shown and described in detail to illustrate the inventive principles, it will be understood that the invention may be embodied otherwise without departing from such principles.

What is claimed is:

1. A hand-guided power tool comprising:

an internal combustion engine comprising a carburetor, the carburetor comprising a carburetor housing in which an intake passage section is formed, wherein the carburetor further comprises a pivotably supported choke element arranged in the intake passage section and operatively connected with a choke actuating lever;

a starter device comprising an operating position, an off position, and at least one start position;

the starter device comprising an actuating element configured to be actuated by an operator;

the starter device further comprising a coupling element connecting by an operative connection the actuating element with the choke actuating lever, wherein the actuating element, when adjusting the starter device from the operating position into the at least one start position, moves the choke element into at least one start position of the choke element correlated with the at least one start position of the starter device;

the operative connection between the actuating element and the choke actuating lever comprising a relative movement device which, in at least one position of the choke element, enables a relative movement of the actuating element relative to the choke actuating lever;

wherein the relative movement device comprises a holding device comprising a guide contour stationarily secured on the carburetor housing;

wherein the guide contour, in the at least one start position of the choke element, holds the actuating element in the at least one start position of the starter device and prevents the actuating element from moving relative to the choke actuating lever from the at least one start position of the starter device into the operating position of the starter device.

2. The power tool according to claim 1, wherein the operative connection comprises a guide element and the relative movement device comprises a slotted hole, wherein the guide element engages the slotted hole, wherein the guide element is moved from a first position into a second position in the slotted hole when the actuating element is moved from the operating position of the starter device into the off position of the starter device.

3. The power tool according to claim 2, wherein the guide element is moved from the first position into at least one third position when the actuating element is moved from the operating position of the starter device into the at least one start position of the starter device.

4. The power tool according to claim 2, wherein the slotted hole comprises a first section, a second section, and a connecting section connecting the first section and the second section with each other, wherein the first section and the second section are positioned at an angle of more than 45° relative to each other, and wherein the guide element in the second position is located in the first section.

5. The power tool according to claim 4, wherein the guide element is moved from the first position into at least one third position when the actuating element is moved from the operating position of the starter device into the at least one start position of the starter device, wherein the guide element in the at least one third position is located in the second section.

6. The power tool according to claim 4, wherein the guide element in the first position is located in the connecting section.

7. The power tool according to claim 2, wherein the guide contour closes off at least one section of the slotted hole for the guide element when the actuating element is in the at least one start position of the starter device.

8. The power tool according to claim 7, wherein the guide contour is provided on a control opening into which the guide element projects.

9. The power tool according to claim 8, wherein the control opening in an operating position of the choke element completely overlaps the slotted hole in a movement range of the coupling element.

10. The power tool according to claim 8, wherein the guide contour is formed on a component fixedly connected with a carburetor housing of the carburetor.

11. The power tool according to claim 2, wherein the guide element is embodied on the coupling element and the slotted hole is provided on the choke actuating lever.

12. The power tool according to claim 11, wherein the coupling element is embodied as a wire bracket and the guide element is an angled end of the wire bracket.

13. The power tool according to claim 1, wherein the choke actuating lever is connected fixedly with the choke element.

14. The power tool according to claim 1, wherein the relative movement device enables the actuating element to move relative to the choke actuating lever from the operating position of the starter device into the off position of the starter device.

15. The power tool according to claim 1, wherein the relative movement device enables the actuating element to move relative to the choke actuating lever from the operating position of the starter device into the at least one start position of the starter device.

* * * * *